US009651337B1

(12) United States Patent
Curry et al.

(10) Patent No.: US 9,651,337 B1
(45) Date of Patent: May 16, 2017

(54) WINDAGE ADJUSTABLE PISTOL SIGHT

(71) Applicant: Smith & Wesson Corp., Springfield, MA (US)

(72) Inventors: Brett Curry, Monson, MA (US); Gary Zukowski, Ludlow, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 15/011,698

(22) Filed: Feb. 1, 2016

(51) Int. Cl.

| | |
|---|---|
| ***F41G 1/26*** | (2006.01) |
| ***F41G 3/00*** | (2006.01) |
| ***F41G 1/10*** | (2006.01) |
| ***F41G 1/08*** | (2006.01) |
| ***F41C 3/00*** | (2006.01) |

(52) U.S. Cl.
CPC ..... *F41G 1/26* (2013.01); *F41C 3/00* (2013.01); *F41G 1/08* (2013.01); *F41G 1/10* (2013.01)

(58) Field of Classification Search
CPC ... F41G 1/033; F41G 1/16; F41G 1/20; F41G 1/22; F41G 1/24; F41G 1/26; F41G 1/28; F41C 3/00
USPC ..... 42/135, 137, 139
See application file for complete search history.

(56) References Cited

U.S. PATENT DOCUMENTS

| | | | | | |
|---|---|---|---|---|---|
| 717,478 | A * | 12/1902 | Wesson | F41G 1/26 | 42/139 |
| 2,187,096 | A * | 1/1940 | Pomeroy | F41G 1/26 | 42/137 |
| 2,351,103 | A | 6/1944 | Brown | | |
| 2,438,601 | A * | 3/1948 | Davis | F41G 1/26 | 42/137 |
| 2,881,524 | A * | 4/1959 | Simeone | F41G 1/26 | 42/137 |
| 2,982,026 | A | 5/1961 | Peterson | | |
| 3,495,339 | A * | 2/1970 | Elliason | F41G 1/26 | 42/137 |
| 3,945,142 | A * | 3/1976 | Keppeler | F41G 1/16 | 42/135 |
| 4,249,332 | A * | 2/1981 | Ng | F41G 1/06 | 42/137 |
| 4,479,307 | A * | 10/1984 | Pomeranz | F41G 1/26 | 42/133 |
| 5,208,407 | A * | 5/1993 | Stover | F41G 1/16 | 42/112 |
| 5,467,552 | A | 11/1995 | Cupp et al. | | |
| D407,788 | S | 4/1999 | Kay | | |
| 6,230,414 | B1 | 5/2001 | Glock | | |
| 7,287,351 | B1 * | 10/2007 | Warren | F41G 1/10 | 42/111 |
| 8,132,496 | B2 | 3/2012 | Zukowski | | |
| 8,276,302 | B2 | 10/2012 | Zukowski | | |
| 8,296,990 | B2 | 10/2012 | Zukowski et al. | | |
| 2007/0199227 | A1 * | 8/2007 | Ertl | F41G 1/26 | 42/137 |

(Continued)

*Primary Examiner* — Bret Hayes
(74) *Attorney, Agent, or Firm* — John A. Chionchio; Ballard Spahr LLP

(57) ABSTRACT

A sight for a pistol has a sliding fit within a channel in the slide of the pistol. A fastener retains the sight to the slide. The fastener passes through a slot in the slide. The slot is surrounded by a countersink surface and has a major dimension oriented transversely to the longitudinal axis of the slide. The fastener has a conical head with a cone angle which may be the same as or different from the angle of the countersink surface.

14 Claims, 3 Drawing Sheets

(56) References Cited

U.S. PATENT DOCUMENTS

| | | | | |
|---|---|---|---|---|
| 2007/0234625 | A1* | 10/2007 | Kidd | F41G 1/02 42/111 |
| 2011/0088306 | A1* | 4/2011 | Nasef | H02G 3/0493 42/136 |
| 2011/0167706 | A1* | 7/2011 | Glock | F41G 1/26 42/111 |
| 2014/0259856 | A1* | 9/2014 | Kruse | F41G 1/16 42/136 |

* cited by examiner

FIG. 3
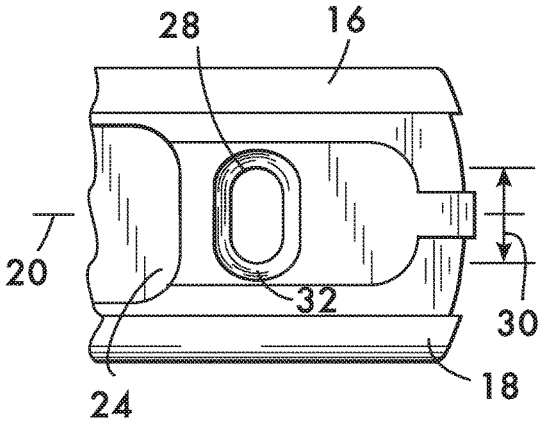
FIG. 4
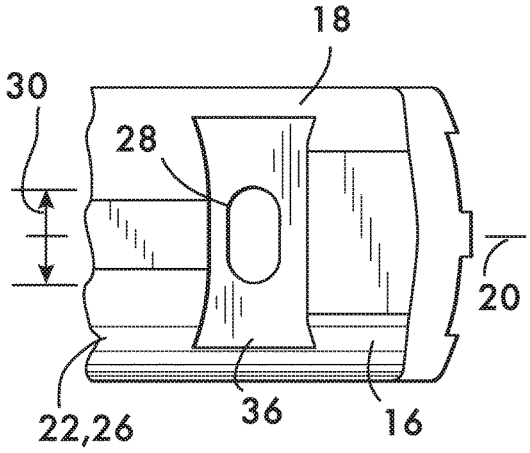
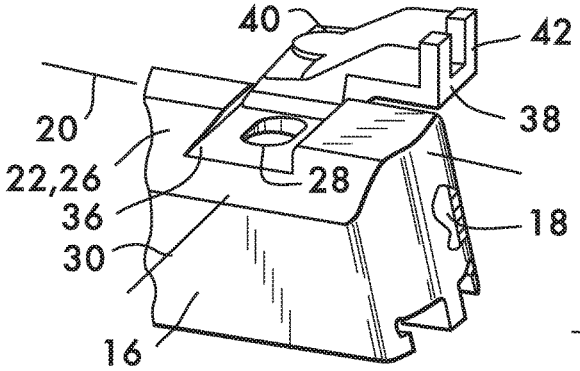
FIG. 6
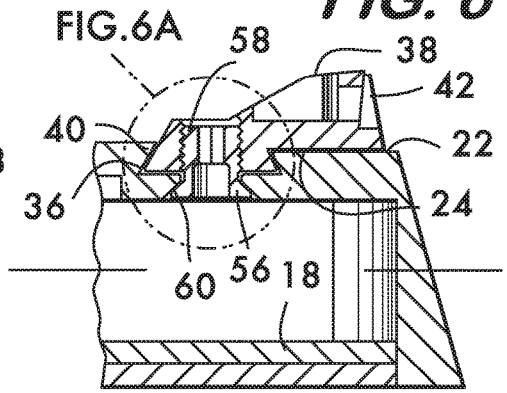
FIG. 5
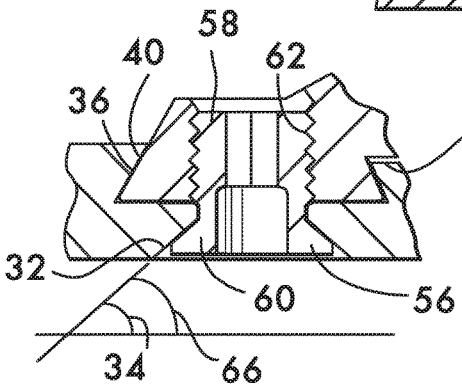
FIG. 6A

WINDAGE ADJUSTABLE PISTOL SIGHT

FIELD OF THE INVENTION

This invention relates to sights for firearms, in particular, sights for semiautomatic pistols.

BACKGROUND

Rear sights used with semiautomatic pistols are commonly attached to the pistol slide using a press fit dovetail interface. This involves fitting a trapezoidal shaped rib on the sight into a channel in the slide, the channel having a matching shape. The fit between the parts has a degree of interference such that high insertion forces are required to effect assembly. Such joints require machining of parts to tight tolerances which is difficult and expensive, and the use of specialized fixtures and presses to join, disassemble, or adjust the relative position of the parts. Assembly of press fit parts induces stress in the parts and may result in damage to them. Press fit interfaces furthermore do not permit practical or precise adjustment of sights, for windage for example, without specialized tools. There is clearly a need for a simple sight installation that obviates these aforementioned disadvantages.

SUMMARY

The invention is directed toward a slide for a semiautomatic pistol. In one example embodiment the slide comprises first and second elongate sidewalls arranged adjacent to one another in spaced relation parallel to an axis positioned between the sidewalls. An elongate top wall extends between the first and second sidewalls. The top wall has an inner surface facing the axis and an outer surface oppositely disposed. A slot is positioned in the top wall proximate to one end thereof. The slot has a major dimension oriented transversely to the axis. A sight is mounted on the top wall overlying the slot. A fastener extends through the slot and engages the sight. The sight is adjustable in position along the major dimension of the slot.

In a further example embodiment the sight comprises a base. By way of example the top wall has a channel therein. The channel overlies the slot and is oriented parallel to the major dimension of the slot. In another example the channel has a cross section sized to receive the base of the sight. The sight is slideably movable within the channel.

In another example embodiment the base has a trapezoidal cross section and the channel has a trapezoidal cross section sized to receive the base. In a specific example embodiment the top wall comprises a countersink surface extending around the slot. The countersink surface faces the axis and is angularly oriented at an orientation angle with respect thereto in this example. The fastener comprises a threaded shaft attached to a conical head. The conical head is received by the countersink surface.

In one specific example embodiment the conical head has a cone angle equal to the orientation angle of the countersink surface. In another example embodiment the conical head has a cone angle that is not equal to the orientation angle of the countersink surface. By way of example the sight may be selected from the group consisting of a u-notch, a v-notch, an express notch, a trapezoid, a Patridge sight and a ghost ring sight.

The invention further encompasses a semiautomatic pistol. In one example embodiment the pistol comprises a frame. A slide is mounted on the frame. By way of example the slide comprises first and second elongate sidewalls arranged adjacent to one another in spaced relation parallel to an axis positioned between the sidewalls. An elongate top wall extends between the first and second sidewalls. The top wall has an inner surface facing the axis and an outer surface oppositely disposed. A slot is positioned in the top wall proximate to one end thereof. The slot has a major dimension oriented transversely to the axis in this example. A sight is mounted on the top wall overlying the slot. A fastener extends through the slot and engages the sight. The sight is adjustable in position along the major dimension of the slot.

In a specific example embodiment the sight comprises a base. The top wall has a channel therein. The channel overlies the slot and is oriented parallel to the major dimension of the slot. The channel has a cross section sized to receive the base of the sight. The sight is slideably movable within the channel.

In a particular example embodiment the base has a trapezoidal cross section and the channel has a trapezoidal cross section sized to receive the base.

Further by way of example the top wall comprises a countersink surface extending around the slot. The countersink surface faces the axis and is angularly oriented at an orientation angle with respect thereto. The fastener comprises a threaded shaft attached to a conical head. The conical head is received by the countersink surface. In one example embodiment the conical head has a cone angle equal to the orientation angle of the countersink surface. In another example embodiment the conical head has a cone angle that is not equal to the orientation angle of the countersink surface. By way of further example the sight may be selected from the group consisting of a u-notch, a v-notch, an express notch, a trapezoid, a Patridge sight and a ghost ring sight.

BRIEF DESCRIPTION OF THE DRAWINGS

FIG. 3 is a bottom view of a portion of the slide shown in FIG. 1;

FIG. 4 is a top view of a portion of the slide shown in FIG. 1;

FIG. 5 is an isometric view of the slide shown in FIG. 1 and an example sight according to the invention;

FIGS. 6, 6A, 7 and 7A are longitudinal sectional views of a portion of the slide and sight shown in FIG. 5.

DETAILED DESCRIPTION

Figure 1:
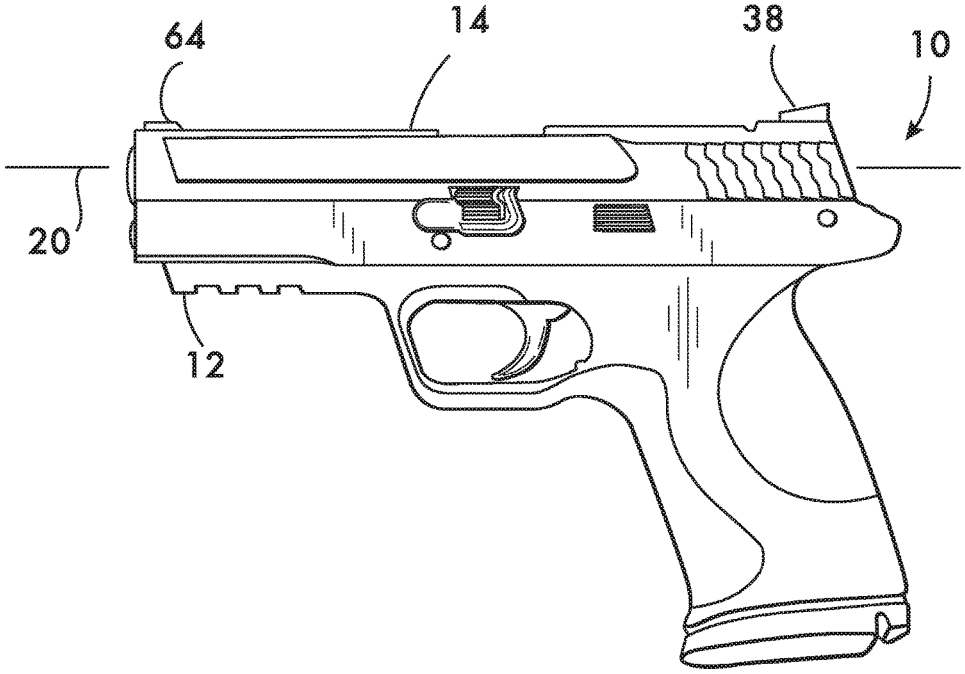
FIG. 1 is a left side view of a semiautomatic pistol having an example slide according to the invention.
Figure 2:
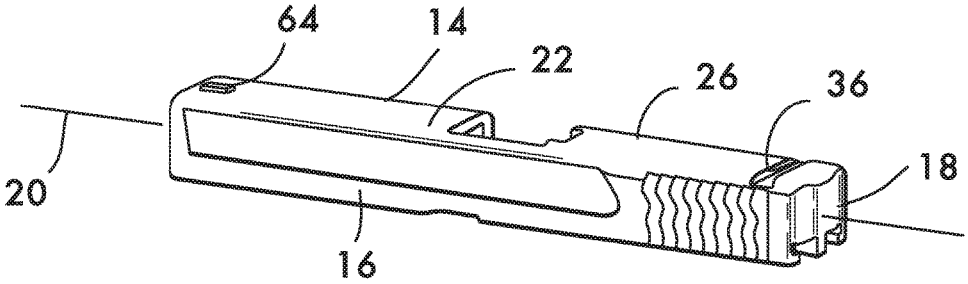
FIG. 2 is an isometric view of the example slide shown in FIG. 1.

FIG. 1 shows an example semiautomatic pistol 10 according to the invention. Pistol 10 comprises a frame 12 on which a slide 14 is mounted. As shown in FIG. 2, example slide 14 comprises first and second elongate sidewalls 16 and 18 arranged in spaced relation and parallel to an axis 20 positioned between sidewalls 16 and 18. An elongate top wall 22 extends between sidewalls 16 and 18. As shown in FIG. 3, top wall 22 has an inner surface 24 which faces axis 20, and, as shown in FIGS. 2 and 4, top wall 22 has an outer surface 26 oppositely disposed to the inner surface. A slot 28 is positioned in top wall 22 proximate one end of slide 14. Slot 28 has a major dimension 30 which is oriented transversely to axis 20. As shown in FIG. 3, a countersink surface 32 is positioned on the inner surface 24 of the top wall 22. Countersink surface 32 extends around slot 28 and, as shown in FIGS. 6 and 6A, is angularly oriented at an orientation angle 34 with respect to axis 20, which the countersink surface faces. Orientation angle 34 is advantageously about 45°, but may range between about 30° to about 60° for practical designs.

Figure 7:
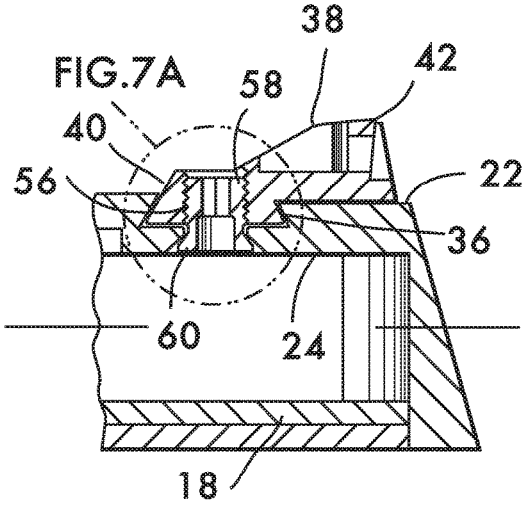
Figure 8:
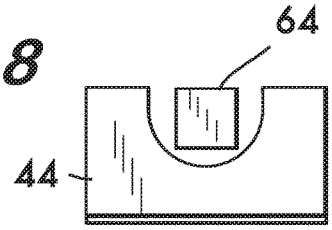
FIGS. 8-13 are examples of types of sights used with the invention.
Figure 9:
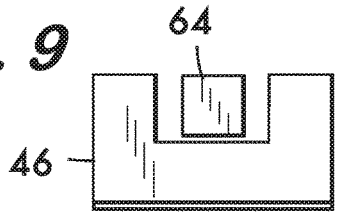
Figure 10:
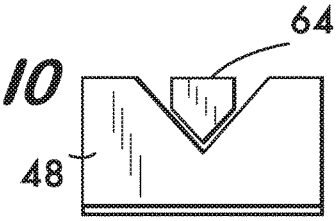
Figure 11:
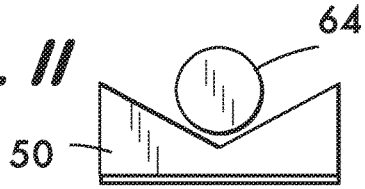
Figure 12:
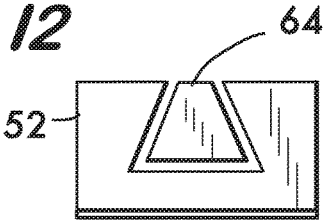
Figure 13:
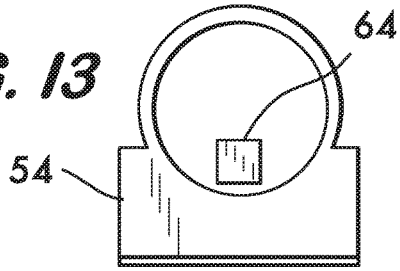

As shown in FIGS. 4 and 5, a channel 36 is positioned within the top wall 22. Channel 36 overlies the slot 28 and is oriented parallel to the slot's major dimension 30. In the example shown, channel 36 has a trapezoidal cross sectional shape. Other cross sectional shapes are also feasible. A sight 38 is mounted on the outer surface 26 of top wall 22. Sight 38 comprises a base 40 that is received in the channel 36 and overlies slot 28. In the example shown in FIGS. 5-7, base 40 has a trapezoidal cross sectional shape matched to the cross sectional shape of channel 36, although other shapes are also feasible. Base 40 supports an alignment feature 42, which may, for example comprise an open sight, such as a U-notch 44 (FIG. 8), the well-known "Patridge" sight 46 (FIG. 9), a V-notch 48 (FIG. 10), an "express" notch 50 (FIG. 11), a trapezoidal notch 52 (FIG. 12) or a closed sight such as the "ghost ring" 54 (FIG. 13).

Figure 7A:
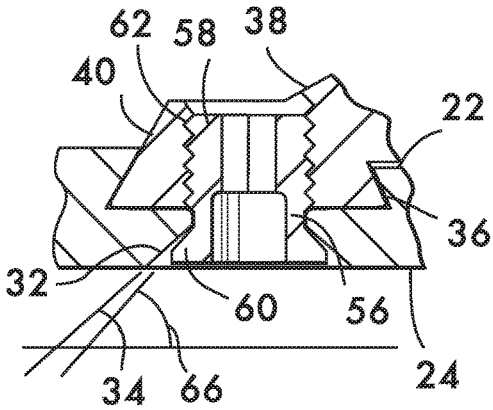

Base 40 is dimensioned relative to channel 36 so that the sight 38 is slidably movable within the channel in a direction along the slot's major dimension 30. As shown in FIGS. 6, 6A, 7 and 7A, a fastener 56 is used to retain the base 40 of sight 38 to the slide 14. Fastener 56 comprises a threaded shaft 58 attached to a conical head 60. Shaft 58 extends through slot 28 from the inner surface 24 of the top wall 22, the conical head 60 engaging the countersink surface 32 and the shaft engaging a threaded hole 62 in the base 40. The base 40 is movable along the slot's major dimension 30 (see FIGS. 3-5) and the fastener 56 and base 40 cooperate to position and hold sight 38 in a position on the slide 14 relative to a front sight 64 (see FIGS. 1, 2 and 8-13) that permits the sight 38 to be adjusted for windage, i.e., to change the horizontal aiming point of the sight. FIG. 6A shows an example embodiment wherein the conical head 60 has a cone angle 66 that is equal to the orientation angle 34 of countersink surface 32. FIG. 7A shows another example embodiment, wherein the cone angle 66 is not equal to the orientation angle 34. It is thought that the condition wherein the cone angle 66 is not equal to the orientation angle 34 will provide increased resistance to the fastener loosening during operation of the pistol.

It is expected that a slide according to the invention will provide an improvement over sights which are press fit into the slide, allowing for more rapid and precise windage adjustment as well as ease of manufacture and assembly.

What is claimed is:

1. A slide for a semiautomatic pistol, comprising:
first and second elongate sidewalls arranged adjacent to one another in spaced relation parallel to an axis positioned between said sidewalls;
an elongate top wall extending between said first and second sidewalls, said top wall having an inner surface facing said axis and an outer surface oppositely disposed;
a slot extending through said inner and outer surfaces of said top wall proximate to one end thereof, said slot defining an opening having a major dimension oriented transversely to said axis;
a sight mounted on said top wall overlying said slot;
a fastener extending through said opening defined by said slot and engaging said sight, said sight being adjustable in position along said major dimension of said slot.

2. The slide according to claim 1, wherein:
said sight comprises a base;
said top wall has a channel therein, said channel overlying said slot and oriented parallel to said major dimension of said slot, said channel having a cross section sized to receive said base of said sight, said sight being slideably movable within said channel.

3. The slide according to claim 2, wherein said base has a trapezoidal cross section and said channel has a trapezoidal cross section sized to receive said base.

4. The slide according to claim 1, wherein:
said top wall comprises a countersink surface extending around said slot, said countersink surface facing said axis and being angularly oriented at an orientation angle with respect thereto;
said fastener comprises a threaded shaft attached to a conical head, said conical head being received by said countersink surface.

5. The slide according to claim 4, wherein said conical head has a cone angle equal to said orientation angle of said countersink surface.

6. The slide according to claim 4, wherein said conical head has a cone angle that is not equal to said orientation angle of said countersink surface.

7. The slide according to claim 1, wherein said sight is selected from the group consisting of a u-notch, a v-notch, an express notch, a trapezoid, a Patridge sight and a ghost ring sight.

8. A semiautomatic pistol, comprising:
a frame;
a slide mounted on said frame, said slide comprising:
first and second elongate sidewalls arranged adjacent to one another in spaced relation parallel to an axis positioned between said sidewalls;
an elongate top wall extending between said first and second sidewalls, said top wall having an inner surface facing said axis and an outer surface oppositely disposed;
a slot extending through said inner and outer surfaces of said top wall proximate to one end thereof, said slot defining an opening having a major dimension oriented transversely to said axis;
a sight mounted on said top wall overlying said slot;
a fastener extending through said opening defined by said slot and engaging said sight, said sight being adjustable in position along said major dimension of said slot.

9. The semiautomatic pistol according to claim 8, wherein:
said sight comprises a base;
said top wall has a channel therein, said channel overlying said slot and oriented parallel to said major dimension of said slot, said channel having a cross section sized to receive said base of said sight, said sight being slideably movable within said channel.

10. The semiautomatic pistol according to claim 9, wherein said base has a trapezoidal cross section and said channel has a trapezoidal cross section sized to receive said base.

11. The semiautomatic pistol according to claim 8, wherein:
said top wall comprises a countersink surface extending around said slot, said countersink surface facing said axis and being angularly oriented at an orientation angle with respect thereto;
said fastener comprises a threaded shaft attached to a conical head, said conical head being received by said countersink surface.

12. The semiautomatic pistol according to claim 11, wherein said conical head has a cone angle equal to said orientation angle of said countersink surface.

13. The semiautomatic pistol according to claim 11, wherein said conical head has a cone angle that is not equal to said orientation angle of said countersink surface.

14. The semiautomatic pistol according to claim 8, wherein said sight is selected from the group consisting of a u-notch, a v-notch, an express notch, a trapezoid, a Patridge sight and a ghost ring sight.

* * * * *